US005566730A

United States Patent [19]

Liebmann, Jr.

[11] Patent Number: 5,566,730

[45] Date of Patent: Oct. 22, 1996

[54] GAS ACTUATOR ASSEMBLY

[76] Inventor: George W. Liebmann, Jr., 75 Bank St. #4E, New York, N.Y. 10014

[21] Appl. No.: 494,341

[22] Filed: Jun. 26, 1995

Related U.S. Application Data

[62] Division of Ser. No. 326,040, Oct. 19, 1994, Pat. No. 5,458,165.

[51] Int. Cl.[6] ..... B65B 31/00

[52] U.S. Cl. ..... 141/64; 141/19; 141/98; 141/59; 99/323.1; 261/DIG. 7; 261/52; 222/399; 215/309; 220/367.1

[58] Field of Search ..... 141/19, 63–65, 141/70, 98, 318, 329, 374, 59, 39; 99/323.1, 323.2; 261/DIG. 7, 77, DIG. 65, 52; 222/399, 5; 128/200.11, 200.12, 203.21; 239/414, 309, 361, 369, 373; 215/228, 309–313; 220/303, 360, 361, 366.1, 367.1

[56] References Cited

U.S. PATENT DOCUMENTS

| | | | |
|---|---|---|---|
| 1,983,381 | 12/1934 | MacGill . | |
| 2,204,833 | 6/1940 | Stone . | |
| 2,314,167 | 3/1943 | Shaw . | |
| 2,593,770 | 4/1952 | Kollsman . | |
| 2,805,846 | 9/1957 | Dewen . | |
| 3,205,923 | 9/1965 | Wilson . | |
| 3,212,537 | 10/1965 | Hinxlage et al. . | |
| 3,343,701 | 9/1967 | Mahoney . | |
| 3,406,079 | 10/1968 | Gibble . | |
| 3,455,349 | 7/1969 | Greenwood et al. . | |
| 3,556,174 | 1/1971 | Gibble et al. . | |
| 3,871,425 | 3/1975 | Fee et al. . | |
| 4,059,113 | 11/1977 | Beinsen et al. . | |
| 4,298,551 | 11/1981 | Adolfsson et al. . | |
| 4,312,171 | 1/1982 | Vadas . | |
| 4,475,576 | 10/1984 | Simon . | |
| 4,477,477 | 10/1984 | Arter . | |
| 4,702,396 | 10/1987 | Gwiazda | 215/311 |
| 4,763,803 | 8/1988 | Schneider . | |
| 4,911,314 | 3/1990 | Schneider . | |
| 4,934,543 | 6/1990 | Schmidt | 215/228 |
| 5,031,799 | 7/1991 | Owen . | |
| 5,069,020 | 12/1991 | Sanfilippo et al. | 141/64 |

*Primary Examiner*—Henry J. Recla
*Assistant Examiner*—Steven O. Douglas

[57] ABSTRACT

A gas actuator assembly for supplying a compressed gas to a container, the assembly includes a self contained supply of compressed gas, preferably in the form of a cartridge of compressed gas which is transmitted through a tube to below the level of a liquid contained in a vessel such as a wine bottle or into a resealable container such as that for the storage of food, an evacuation tube that is provided to remove air from the vessel and an activating device for simultaneously activating the flow of compressed gas and the evacuation of air.

14 Claims, 8 Drawing Sheets

GAS ACTUATOR ASSEMBLY

This is a divisional application of U.S. Ser. No. 08/326,040, filed on Oct. 19, 1994, now U.S. Pat. No. 5,458,165.

BACKGROUND-FIELD OF THE INVENTION

This invention is directed to a gas actuator assembly for the injection of a compressed gas into a sealed vessel and the evacuation of air therefrom, for the carbonation of fluids in open or sealed vessels, and for the controlled release of gas from a compressed source.

BACKGROUND-THE PRIOR ART

This invention serves as a multipurpose portable tool with three primary applications: to maintain the quality of a partially-consumed container or wine or other oxidizable fluid, to allow simplified carbonation or recarbonation of soft drinks, seltzer or other beverages, and to serve as a convenient portable tool for the displacement of air or other gases from bottles, beakers or other enclosed containers, especially those containing foods. Prior art includes devices for each specific task but does not include devices with similar combined usage. Hence, this device provides a unique efficiency and functionality. Furthermore, this device provides substantial and unique improvements in the accomplishment of each of the aforementioned primary applications.

It is well known to most connoisseurs and other drinkers of wine that the quality of wine remaining in a container after its contents has been partially dispensed, deteriorates rapidly. This is due to chemical reactions between the wine and molecules of air in contact with it. The chemistry of wine is very complex, its ingredients and flavoring agents may number over a thousand. Wine is known to be very sensitive: slight changes in just a few of these ingredients can dramatically alter the taste and drinkability of the wine. Oxygen is perhaps wine's greatest enemy, although there are thought to be other ingredients in air that can react with wine. Oxygen causes oxidation of many major components of the wine, which in turn can cause chain reactions that can dramatically alter the taste of the open container of wine after only a few days. This problem is particularly acute with many red wines, which connoisseurs often regard as undrinkable after more than a day of exposure to air. Almost all wines become undrinkable after a few days of exposure to air.

Indeed, this problem has confounded winemakers for many years. In wineries, expensive, large, and elaborate devices are employed to create powerful vacuums to eliminate air or that use complex inert gas systems to isolate wine from air. However, this problem has not been sufficiently addressed at the consumer level. This has had a profound sociological effect: individuals who might want just one or two glasses of wine with a meal or as a cocktail, may find that it is uneconomical to fulfill their desires, as to do so would involve wasting much of a bottle of wine. The rapidly increasing prices of wines make these economic considerations even more acute. Furthermore, this problem has made the enjoyment of exotic wines such as the first-growth Bordeauxes, economically unattainable for those whose means do not allow them to easily envision consuming a bottle of wine, possibly costing several hundred dollars, at one sitting. Such an individual might find it easier to try a bottle of such wine of he could spread its enjoyment over a longer period of time. This invention would also allow smaller restaurants to offer larger winelists by the glass or carafe, as spoilage of unfinished bottles of wines would cease to become a consideration, thereby allowing people of average means to occasionally sample fine wines without having to make an unaffordably large expenditure on an entire bottle. Before this invention, such opportunities did not exist. Much wine has been wasted and much potential demand for wine has gone unfulfilled.

Prior art ways for the consumer to diminish the damage caused by air on wine has varied from the simple: recorking the bottle, to the absurd; inserting balloons into bottles to help displace some of the air (U.S. Pat. No. 3,343,701). The former is ineffective as it fails to remove the air under the cork that displaced the consumed wine, and the latter, impractical and ineffective, as the balloon is subject to rupture, fails to displace all of the air, and tends to tarnish the flavor of the wine by virtue of its direct contact. Other approaches have included consumer devices for creating vacuums in the bottles of the wine (U.S. Pats. No. 4,763,803 and 4,911,314). Such devices are ineffective for several reasons: first they do not create vacuums strong enough to eliminate all of the air. To do so would make the seals extremely difficult for the consumer to open and would tend to pose problems of the wine possibly being sucked into the sealer pump during application of suction. There is also the problem of risk to the disparities in pressure causing the bottle to crack. Seating the stopper firmly during suction would also be rather problematic for most consumers. Furthermore, the slit valves utilized in present designs tend to leak air over time and are inconsistent with the restraint of a strong vacuum. The nature of the movable parts, particularly in the pump mechanism, also contributes toward a limited lifespan for the device: the seals and springs in such air pumps are known to degrade over time.

Those skilled in the food-packing art have used non-reactive gases to displace air in the sealing of foods and beverages. Examples of such usage is exemplified by U.S. Pat. Nos. 586,632, 1,263,278, 2,204,833, 2,333,898, 2,705,578, 2,758,766, 2,862,528, 3,212,537, 3,406,079, 3,556,174, 3,804,133, 3,837,137, and 4,312,171. However, these patents are directed toward the sealing of a filled container and not to the particular problems confronted by consumers who open sealed containers and wish to reseal them, particularly when the contents have been partially depleted.

Two devices which utilize inert gases to help preserve wine that has been opened and partially consumed are disclosed in U.S. Pat. Nos. 4,475,576 and 4,477,477. However, both of these patents use designs and methods inferior to those proposed in this application.

U.S. Pat. No. 4,475,576 discloses a stoppering apparatus that provides multiple stoppers which are designed to have the "dispensing head of an inert gas dispenser" plugged directly into the stopper. The device makes use of check valves in the stopper to seal the contact point of the injection apparatus and the evacuation aperture. Typically, such a stopper would take the form of a tapered rubber cork with molded check valves described as "a resilient tubular sleeve with a pinched downstream end permitting gases to pass only from within the tube out through the pinched end." These pinched check valves (similar to those of U.S. Pat. Nos. 4,763,803 & 4,911,314) are subject to degradation, as they are fairly flimsy in design and tend to deteriorate over repeated use. These valves are also subject to blockage or leakage, as small particles sticking within the pinched area can easily break the seal, admitting air. Wine is also likely to splash into this area and create deposits which can cause blockage or seal failure. Such a design also forces the consumer to face the troublesome task of carefully cleaning each stopper before and after each use, in order to prevent such accumulation in the valves. Such necessary cleaning can also damage these valves. These pinched valves, as they are seated within a resilient seating, are also likely to deform through repeated use as the stopper flexes with repeated insertion into bottles. These check valves which release at "slightly above one atmosphere of pressure," are likely to break their seals should the gases within the bottle expand or contract with significant changes in temperature.

Such flaws in the sealing mechanism, while an improvement over prior devices are disadvantageous because the valves deteriorate over time and are not suitable for the storage of wine for periods longer than a couple of weeks. The design also presumes the need for a countertop inert-gas dispenser and is inferior because it is not easily portable. Furthermore, the seat in the stopper for the "dispensing head of an inert gas dispenser" is likely to be stretched and deformed over repeated use, thereby decreasing its lifespan. The design for this type of seating head also may be problematic for many consumers, particularly those with arthritis or poor eyesight, as it requires that the inert gas dispenser head be properly aligned and sealed with the stopper, all in a very small area of space (the stopper of a bottle). The stopper, due to its small surface area, can also be difficult to remove, as it does allow one's hand to sufficiently grip it and thereby attain much leverage. This problem will be particularly acute with bottles with narrow necks. Finally, this device is limited for use with wine, and cannot be easily used with opened containers of juices, foods, or for other applications.

U.S. Pat. No. 4,477,477 discloses a method and system for preserving wine that includes a source of pressurized, inert gas, and a delivery apparatus to a bottle. The device includes numerous parts and exposed connections and is awkward to use and transport, and is easily susceptible to damage. The device requires several steps in order for it to work that would be undesirable for those consumers who are not mechanically-inclined.

The device includes a source of inert gas, a valve, a connecting tube connected to the valve, which in turn is connected to an adjustable nozzle, which in turn is connected to a mounting device similar to a straight stopper, within which its height is adjustable by sliding the nozzle up and down and tightening with a positioning means. The nozzle is required to be positioned directly above the surface of the wine. This mounting device is held in place in the bottle by a "mounting means comprising a plurality of supports projecting in spaced relationship around the perimeter of said mounting means." The spaces between these mounting means are designed to allow the expelled air to escape. One is supported to use the device to place an inert gas cover atop the wine and then remove the device and recork the container.

This prior art device has several undesirable design features. The tubing connecting the valve on the gas source to the adjustable nozzle is prone to breakage, leakage, and dry rot. This could shorten the lifespan of the device and may allow some air to be sucked into the injection tube and into the bottle. This tubing is also prone to slipping off both the valve and the adjustable nozzle, causing failure of the device. The device also requires that the nozzle be adjusted up and down within the stopper (mounting device). This is undesirable, as it is prone to creating leaks over time as the fit between nozzle and stopper becomes less snug over repeated movement of the nozzle. Use of a screwpin to tighten the nozzle would tend to create a shorter lifespan for the device as the pin is likely to be lost or the threads worn down over repeated use. Such a pin would also damage the nozzle. It also requires several needless steps in adjusting the height of the nozzle. The device is also intended to position the injection nozzle over the surface of the wine. This method does not provide the benefits of inserting the nozzle beneath the surface of the wine, allowing the gas to bubble upward. Such a method would allow the inert gas to not only displace the air in the bottle more reliably, by assuring a better fill of the headspace, it would also allow much of the air that was dissolved in the wine to be displaced by the inert gas.

The supports which surround and hold up the "mounting means" and create spaces for the expelled air to escape are not only awkward and time-consuming to put into place, they also do not address the problems posed by bottles with different neck sizes. A wide neck would mean that these supports would fail or that the stopper would be fit only loosely into the bottle. A small neck may preclude these supports from fitting or may cause the stopper to be so compressed against the supports that many of the ventilation spaces are closed, leading to dangerous pressure levels developing within the bottle as the compressed gas is injected. These spaces also do not allow the bottle to develop a true seal while the stopper is in place, nor is this the intent of the device. In fact, the design is such that the user is supposed to remove the entire apparatus and then install a cork or other seal atop the head of inert gas. This method permits air to be trapped above the inert gas and under the cork. This air under the cork still allows the wine to be somewhat compromised by the effects of oxidation. Convection and human agitation of the bottle are likely to allow the air to directly contact the wine, even in the presence of a blanket of inert gas.

The stopper, due to its small surface area, can also be difficult to remove, as it does allow one's hand to sufficiently grip it and thereby attain much leverage. This problem will be particularly acute with bottles with narrow necks. This device is also limited for use with wine and cannot easily be used to preserve opened containers of juices, foods, or for other applications.

A second primary use for the present device is for the carbonation of beverages, including water to make seltzer, and juices to make more nutritious sodas. This device would also allow soft drinks which have gone "flat" to be easily recarbonated. It would also allow previously opened containers of soft drinks to be sealed, preventing decarbonation and spoilage.

Devices have been made to carbonate beverages for professional and bulk usage and to carbonate beverages for home use. Prominent examples are disclosed in U.S. Pat. Nos. 2,593,770, 4,298,551, and 5,031,799. However, most of these apparatuses are not readily portable, difficult to clean, and dedicated solely for carbonation. Portable carbonators tend to be of the seltzer-bottle variety, exemplified by U.S. Pat. No. 2,805,846. These devices are designed to carbonate entire containers and are generally not designed to allow a consumer to quickly and easily carbonate a single glass of orange juice or other beverage that is not necessarily in a bottle or closed container.

Most carbonators of the portable variety carbonate the contents of a single bottle specifically designed for that carbonator. They also tend to be difficult to clean and maintain. They also fail to provide utility outside of carbonation. Furthermore, most existing devices are sealed systems that permit dangerous pressure levels to build up inside the bottles, hence requiring that the bottles be reinforced with metal or wire mesh to prevent explosion as compressed gas is injected.

A third primary use for the present device is for the removal of air from bottles, beakers and other enclosed containers. Those skilled in the food-packing art have long been familiar with the use of various unreactive gases to displace air in the sealing of foods and beverages. Examples of such usage are exemplified by U.S. Pat. Nos. 586,632, 1,263,278, 2,204,833, 2,333,898, 2,705,578, 2,758,766, 2,862,528, 3,212,537, 3,406,079, 3,556,174, 3,804,133, 3,837,137, and 4,312,171. These patients are directed toward the sealing of a filled container and not to the particular problems confronted by consumers who open sealed containers and wish to reseal them, particularly when the contents have been partially depleted.

Each year, enormous amounts of food are wasted, as consumers do not fully consume the food that they purchase. Many throw out whatever food is left over after a meal, as they know that even with refrigeration, the food will quickly deteriorate. Most deterioration is caused by direct oxidation of the food by air and by the destruction of bacteria, which feed off of the food and the air. Dehydration is also a contributing factor. The thrifty have long recognized that food keeps longer when they are kept in sealed containers and/or refrigerated. Efforts to retard spoilage by reducing exposure to air vary from wrapping the food in waxed paper or aluminum foil to placing it into a lidded container such as Tupperware® or other containers with tightly-fitting lids. This may increase the shelf life of most foods by as much as several days. Yet eventually, oxidation and bacteria takes its toll, rendering the food inedible. Most previous devices tend to attack the problem by decreasing the amount of air present in the sealed containers by making the containers better conform to the shape of the food or perishable therein. Container manufacturers offer containers in various sizes, in an effort to provide one that more closely matches the need at hand. The problem with the lidded containers is that their inherent rigidity does not allow them to conform closely to non-liquid foods. Subsequently, much air tends to remain under the lid.

Most recent advances have occurred in the design of zipper-style locking plastic bags (U.S. Pat. Nos. 4,212,337, 4,363,345, 4,829,641, 4,907,321), which allow the flexible membrane of the wall of the bag to be pressed close to the food, thereby leaving little room for air. The partially-airtight zipper seal helps to keep moisture in and most air out.

Yet even these methods are imperfect, as enough air still remains in the bags to do significant damage to the food. Also, the zipper seals tend to break apart fairly easily and the bags are generally not intended for extended use. Plastic bags are also not compatible with sealing food that is still hot or food that is very messy. Foods are also harder to extract from plastic bags than they are from the lidded containers. It would therefore be a significant advance in the art of storing foods, including beverages such as wine, to provide a device which preserves the food with an inert gas to that little if any air is in contact with the food during storage and which is capable of carbonating beverages, as well.

BRIEF DESCRIPTION OF THE DRAWINGS

The following drawings, in which like reference characters indicate like parts, are illustrative of embodiments of the invention and are not intended to limit the invention as encompassed by the claims forming part of the application.

SUMMARY OF THE INVENTION

The present invention is directed to a gas actuator assembly for supplying a compressed gas to a container, the assembly includes a self contained supply of compressed gas, preferably in the form of a cartridge of compressed gas which is transmitted through a tube to below the level of a liquid contained in a vessel such as a wine bottle, an evacuation tube that is provided to remove air from the vessel and an activating device for simultaneously activating the flow of compressed gas and the evacuation of air.

DETAILED DESCRIPTION OF THE INVENTION

Figure 1:
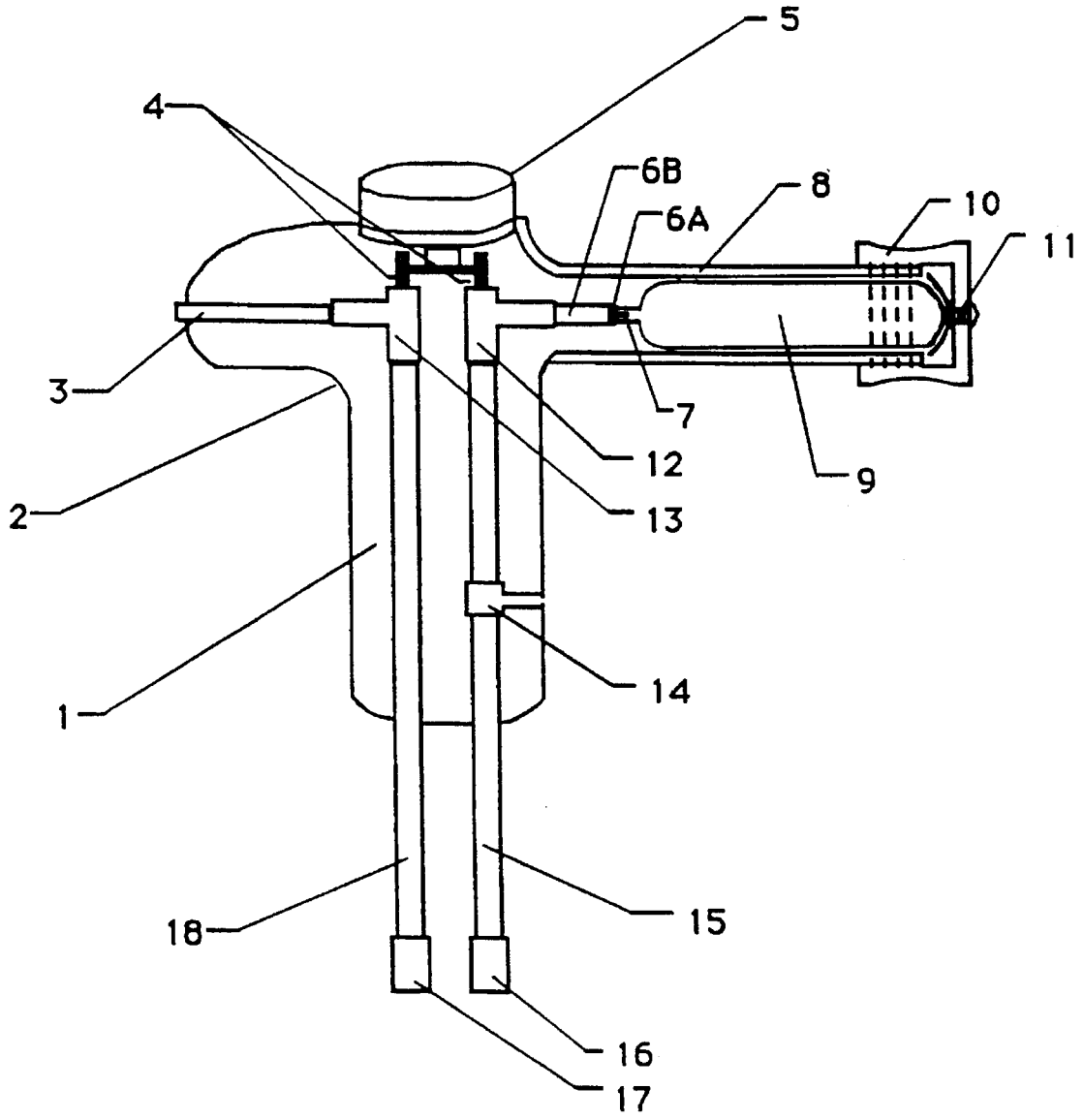
FIG. 1 is a side view of a gas actuator assembly, in accordance with the present invention.

FIG. 1 represents a typical embodiment of a gas-source actuator assembly. The assembly is intended to serve as the primary component of the preservation/carbonation system of the present invention, to which attachments can be connected. The bulk of this device is housed inside of an external housing (1). Said housing serves to protect and position internal components and gas source, while also serving as a simple means for holding and positioning said actuator. A preferred embodiment of the external housing (1) includes a grip for placing the index finger (2) and a handgrip (8) for positioning the third, fourth, and fifth digits of the operator's hand and housing a replaceable seltzer-bottle style gas cartridge or other gas source (9). The handgrip (8) is provided with screwthreads or other means for securing a positioning cap (10) for the installation and removal of the gas cartridge (9). There is also provided an an opening for a large thumb-activated button (5), an opening for an emergency pressure release valve (14), an opening for an exhaust tube for evacuated air (3), openings for a gas-source component connector tube (16) and an air exhaust component connector tube (17). The housing is typically constructed out of a durable hard material, such as plastic or metal. The housing is preferably the approximate size of an adult human hand.

Contained within the housing (1) is a cartridge positioning guide (11) attached by a screw or other means to the screw cap (10). As the screwcap (10) is tightened, the cartridge positioning guide (11) contacts the rear end of the gas cartridge (9), pushing the gas cartridge (9) toward a hollow connecting pin (7). Further tightening of screwcap causes the hollow connecting pin (7) to puncture the neck-end of the gas cartridge (9), thereby causing gas to flow from the gas cartridge (9) through the hollow connection pin (7) through a gas transport tube (6B) to an actuator control valve (12) for the gas source, which prohibits further flow of the gas unless the button (5) is pressed. A pliable connector seal (6A), similar to a rubber washer, is affixed to the gas transport tube (6B), surrounding the base of the hollow connector pin (7). As the screwcap (10) is fully tightened, the pressurized gas cartridge (9) is pushed snugly against the pliable connector seal (6A), thereby sealing the mouth of the pressurized gas cartridge (9) to prevent leakage of any gas from the connection and to prevent air from leaking into the connection.

The actuator button (5) is connected to valve activators (4) of actuator control valves (12) and (13). Depressing said button causes both valve activators (4) to open valves (12) and (13), in tandem. The opening of the control valve (12) for the gas source allows source gas to pass from gas transport tube (6B) through the control valve (12) into an actuator gas source lead tube (15) which directs the flow of gas downward to a peripheral attachment, as described hereinafter. On the gas source lead tube, there is an emergency pressure release valve (14) which will vent gas from the lead tube (15) to outside of the housing (1) in the event that blockage of gas flow causes dangerous pressure levels to develop in the lead tube (15). Said emergency release valve (14) preferably opens only under conditions where the pressure in the lead tube far exceeds one atmosphere, where such pressure, if unvented, may pose a danger to the operator of the system or to the structural integrity of the system itself.

The simultaneous opening of the air exhaust control valve (13) allows evacuated air to pass upward from an actuator exhaust lead tube (18) through the air exhaust control valve (13) through the exhaust tube for evacuated air (3). The release of the button (5) causes both actuator control valves (12) and (13) to close. On the bottom of both the actuator gas source lead tube (15) and the actuator gas source lead tube (18), are connectors (16) and (17), which allow said lead tubes to be easily connected to the tubes of the peripheral accessories described hereinafter. In a preferred embodiment, the connectors (16) and (17) are short tubes having diameters sufficiently in excess of the diameters of the lead tubes (15) and (18) and the tubes of the peripheral devices to which the lead tubes are to be connected. One end of each connector is permanently connected and sealed to its respective lead tube (15) or (18). The inside of each connector (16) or (17) is lined with a pliable material such as rubber or polytetrafluoroethylene, to improve the airtightness of the connection seals when the tubes of the peripheral devices are inserted into the connectors.

Figure 2:
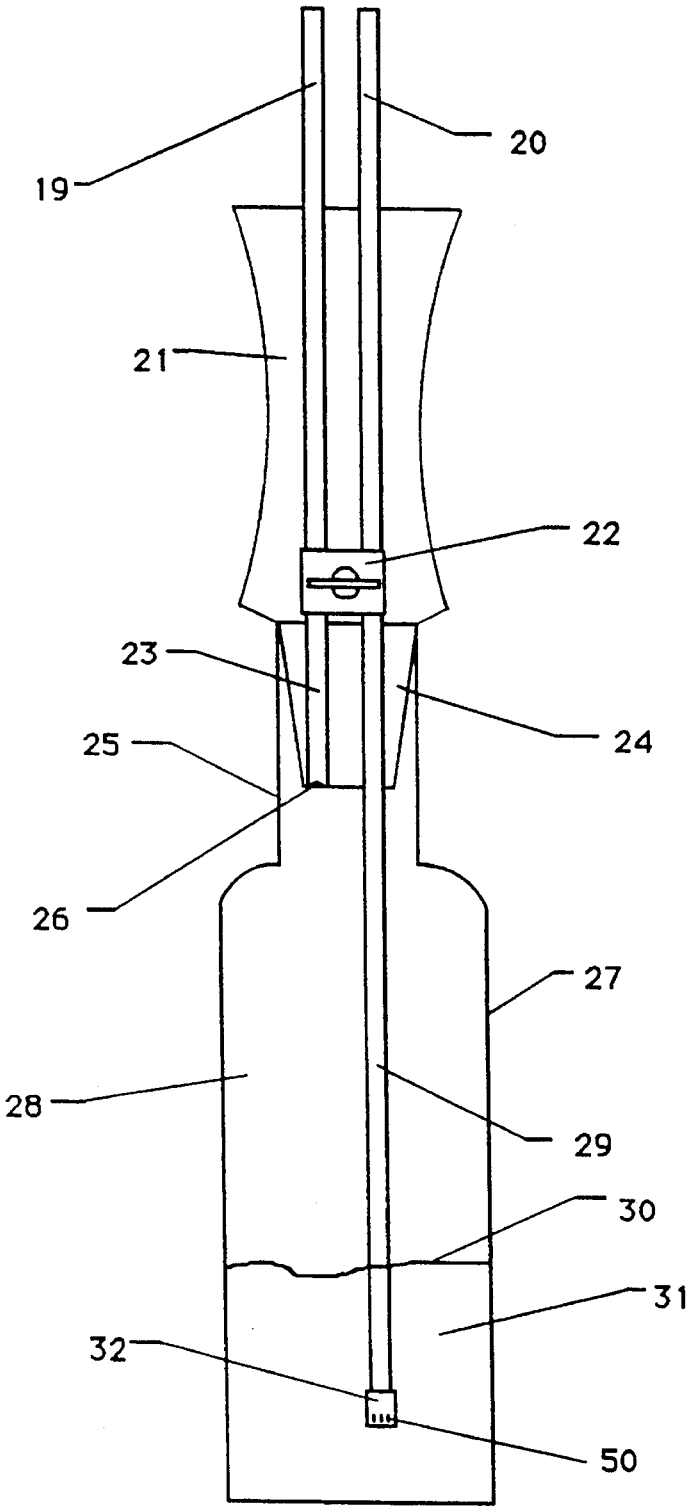
FIG. 2 is a side view of a bottle injection and sealing apparatus in accordance with the present invention, shown placed into a bottle.

FIGS. 2–9 disclose devices which may be attached to the gas actuator assembly in accordance with the present. Referring to FIG. 2, there is shown a preferred embodiment for a bottle injection and sealing apparatus (bottle injector) that operates as a peripheral attachment to the device of FIG. 1. For clarification purpose, the apparatus is shown inserted into the neck (25) of a bottle (27) of wine or other fluid (31). As shown, the primary gas injection tip and connector (32) has been immersed below the surface (30) of the wine of other fluid (31). The device has an external housing (21) which serves to position and protect the valve components (22), the bottle injector exhaust tube (19) and the bottle injector gas lead tube (20), while also serving as a convenient handle for the operator to insert and remove the device from a bottle (27). The external housing (21) is made of a solid material, such as metal or plastic. Attached to an external housing (21), thereby forming an integral unit, is a tapered bottle corking interface (24), made of or covered with a pliable resilient material such as rubber. Said corking interface is tapered downward, with the topmost portion wider than the necks of most conceivable wine bottles, with the lower portion sufficiently narrow as to fit into most narrow-necked wine bottles. Such tapering allows the device to easily fit snugly into bottlenecks ranging in size from the very wide to the very narrow. The pliable, resilient material of the corking interface (24) causes said interface to fit snugly against the internal wall of a bottle's neck (25), thereby creating an airtight seal between the corking interface (24) and the neck of the bottle (25).

A gas lead tube (20) extends from above the external housing, then through the housing into an internal sealing valve (22). On the bottom of said valve, the flowpath continues into a lower gas lead tube (29( extending into the bottle (27).

Similarly, a bottle injector exhaust tube (19) extends from above the external housing, then through the housing into an internal sealing valve (22). On the bottom of said valve, the flowpath continues into a lower injector exhaust tube, which shall terminate with an exhaust aperture (26) flush with the bottom of the tapered bottle corking interface (24). The exhaust aperture (26) is thus positioned within the bottle at the highest point possible. The high positioning of the exhaust aperture (26) serves three advantages: (a) if an inert gas with a molecular weight greater than that of oxygen is used (e.g. Argon), the heavier inert gas would naturally tend to push the lighter gas (28) (air or oxygen) upward, hence it is desireable to vent the system at the upwardmost point, (b) placing the exhaust aperture (26) far from the injection tip (32) and at a high position assures that air is initially vented, as the pressure of the incoming and rising gas will tend to force the air in the headspace above the wine (or other liquid) upward, toward the corking interface, and (c) placing the exhaust aperture as high as possible minimizes the change of wine leaking, splashing, or being propelled into the bottle injection and sealing apparatus.

The top of the bottle injector gas lead tube (20) is connected to the gas source component connector (16) of FIG. 1. Similarly, the top of a bottle injector exhaust tube (19) is connected to the air exhaust component connector (17) of FIG. 1, thereby providing a completed circuit for the injection of an inert gas and the removal of air contained within the bottle.

Figure 3:
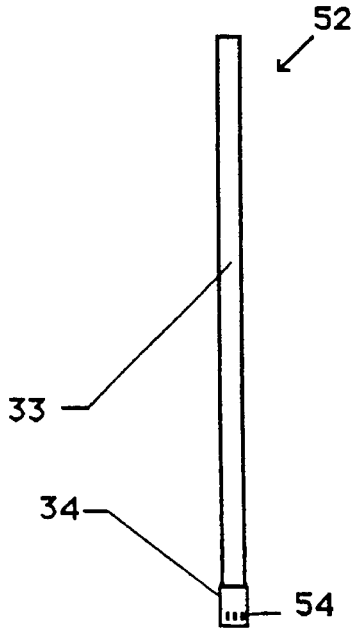
FIG. 3 is a side view of an extension tube for attachment to the gas actuator assembly for carbonation use, or to the bottle injection and sealing apparatus for use in preserving bottled fluids.

Attached to the bottom of the lower injector gas lead tube (29) is a connector (32) similar to the connectors (16) and (17). The connector (32) may be provided with small holes (50) through the lower portion of the walls of the connector. The holes (50) allow bubbles of gas to pass through the sides of the connector to facilitate injection of gas into a bottle. Positioning of the holes (50) on the lower sides of the connector will not interfere with the creation of an airtight seal, should an extension tube (52) as shown in FIG. 3 be inserted into the connector, as there will be enough contact surface area above the holes to allow for such a seal.

The sealing valve (22) simultaneously opens or closes both the gas lead passages (20) and (29) and the air exhaust passages (19) and (23). Hence, when the valve (22) is closed, the contents of the bottle are effectively sealed from the outside. Conversely, when the valve (22) is opened, the bottle is unsealed, allowing gas to be injected through the passages (20) and (29), and air to be evacuated through the passages (23) and (19).

Although it is not necessary for the injection tip (32) to be immersed in the wine (or other liquid) for the device to function properly in evacuating air from a bottle, it usually will be preferred to help displace air that has dissolved in the liquid, as well as air in the headspace above the liquid. Nitrogen gas is somewhat soluble in wine. Consequently, should it be used, one may wish to position the injection tip (32) above the wine. However, it should be observed that even if some nitrogen gas is dissolved into the wine, it does not tend to alter its drinkability.

Referring again to FIG. 3, the extension tube (52) which is designed to fit into the primary injection tip and connector (32) of the injection and sealing apparatus of FIG. 2. Such connectors allow the injection site to be lowered in the event that a tall bottle and/or a bottle with a very small amount of wine is used. Such connectors can also be connected in series, one to another, in order to further elongate the gas lead tube (29). The extension tube (52) attaches directly to the gas source component connector (16), for use in beverage carbonation as described hereinafter. The extension tube (52) includes a shaft (33) and a gas injection tip and connector (34), similar in design and attachment to that of the injection tip (32). The shaft (33) is a tube of similar design and diameter to the tubing used throughout the system and will easily fit snugly inside connectors (16) for carbonation use or the connectors (32) or (34) for bottle injection use. The extension tube (52) may also be provided with small holes (54) on the side of the connector (34) to allow bubbles of gas to pass therethrough.

Figure 4:
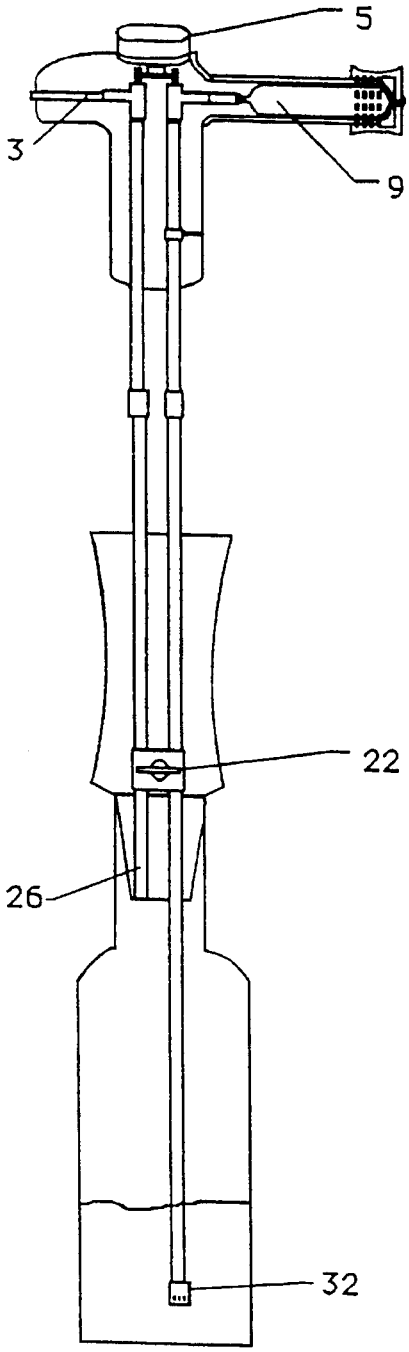
FIG. 4 is a side view of the gas actuator assembly shown in FIG. 1 attached to a bottle injection and sealing apparatus, as shown in FIG. 2.
Figure 5:
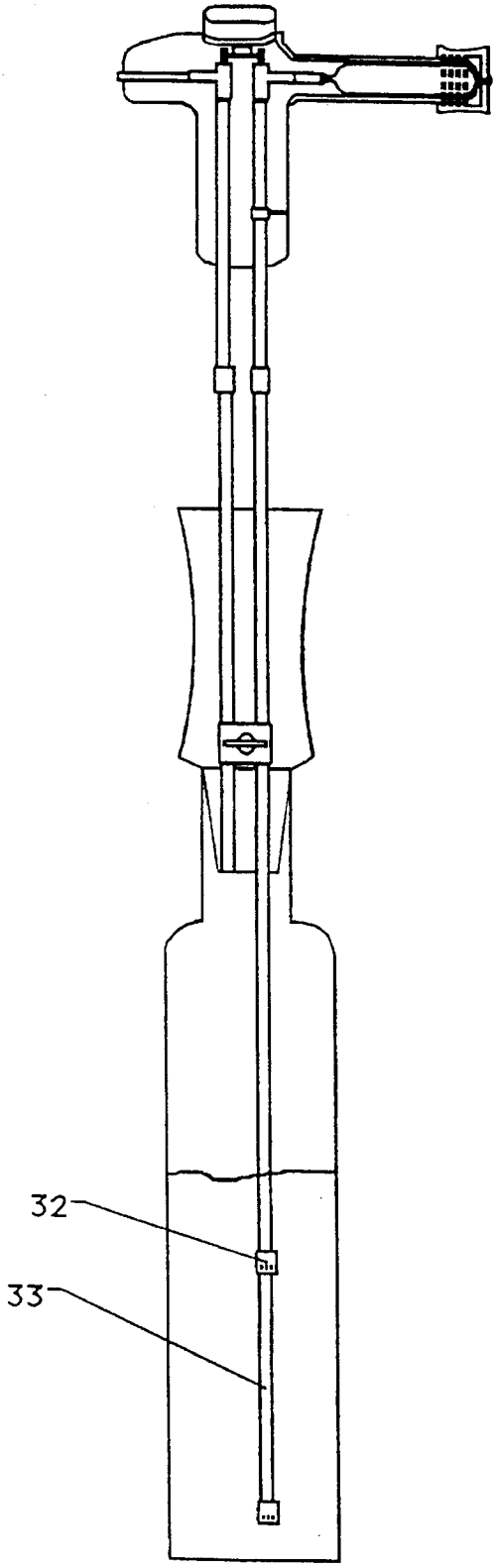
FIG. 5 is a side view of the system of FIG. 4 including an extension tube attached to the bottle injection and sealing apparatus.

FIGS. 4 & 5 illustrate how the components would look if connected together for the preservation of a bottle of wine or other liquid. In order to seal a wine bottle, the actuator assembly shown in FIG. 1 is provided with a cartridge (9) of pressurized unreactive or inert source gas, such as nitrogen, argon or helium. Illustrated is the actuator assembly shown in FIG. 1 properly attached to the bottle injection and sealing apparatus shown in FIG. 2, which has been snugly placed into a bottle of wine or other fluid. When the sealing valve (22) on the bottle injection and sealing apparatus is open, and the button depressed, gas will flow from the pressurized gas cartridge (9) into the bottle through the gas injection tip (32). The air in the bottle will be exhausted through the exhaust aperture (26) and eventually out through the exhaust tube (3) of the actuator. The pressure release valve (14) is preferably provided (see FIG. 1) in the event the operator accidentally fails to open the injector sealing valve (22) before depressing the button (5). In this event, gas pressure will unacceptably build up between the sealing valve (22) and the cartridge (9). This hazard is eliminated by the inclusion of an emergency release valve (14), which provides the gas a controlled means of escape. The valve (14) may be designed to emit a signal (e.g. a hissing sound) if activated to alert the operative of the failure to open sealing valve (22).

FIG. 5 provides for an extension tube (52) to be attached to the primary injection tip and connector (32) of a bottle injection and sealing apparatus. The extension tube (52) allows the injector to be adapted for operative connection to taller bottles.

The devices shown in FIG. 4 and FIG. 5 can also be used to carbonate a bottle of liquid. In this embodiment of the invention, a cartridge of compressed carbon dioxide gas is used as the gas source (9) in the actuator assembly. Bubbling carbon dioxide gas through a liquid causes carbonation to occur within 5–10 seconds, for most applications.

Figure 6:
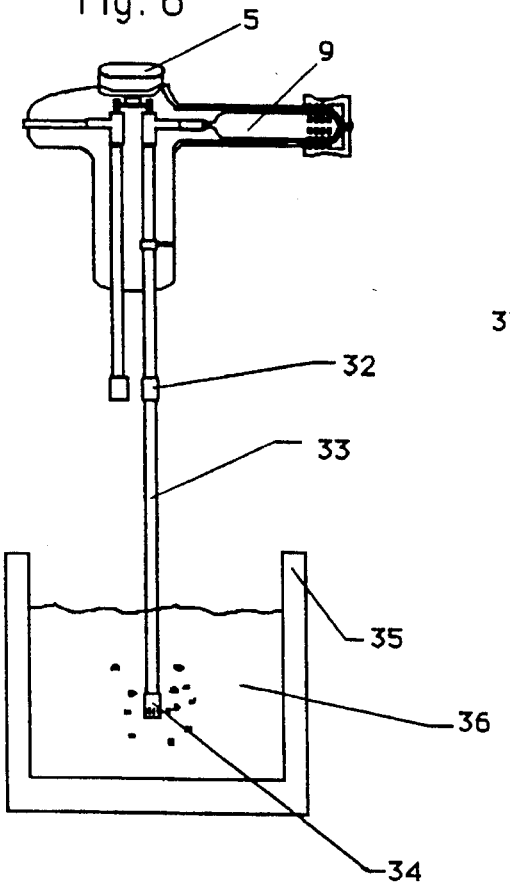
FIG. 6 is a side view of the gas actuator assembly, including an extension tube, which is inserted into a glass of a carbonated beverage.

FIG. 6 illustrates an embodiment of the invention adapted for carbonation of a beverage within a glass. The actuator of FIG. 1 is attached to an extension tube of FIG. 3 at the primary gas injection tip and connector (32). The extension tube gas injector tip (34) is inserted into the beverage (36) in a glass or other container (35). For this embodiment, the gas source (9) must be compressed carbon dioxide, hence a carbon dioxide cartridge must be inserted into the actuator as described in the discussion of FIG. 1. Depressing the button (5) will cause carbon dioxide gas to flow from the cartridge (9) in the actuator, through the shaft of the extension tube (33) through the extension tube gas injection tip (34) into the beverage. Carbon dioxide gas vigorously injected into a beverage, in the method described, will cause the beverage to become well-carbonated after 5–10 seconds, for most applications.

Figure 7:
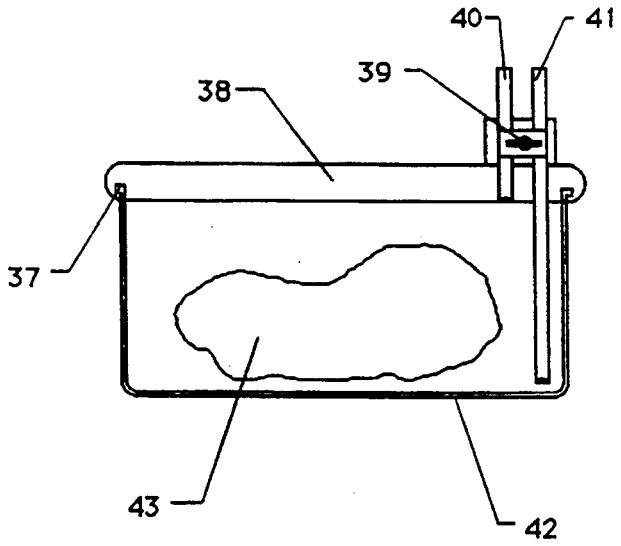
FIG. 7 is a side view of a container for the preservation of food or other perishables, attached to a gas actuator assembly.

FIG. 7 illustrates a specialized container and lid assembly for the preservation of food, beverages, or other perishables (43), designed to be used in conjunction with an actuator assembly of the type illustrated in FIG. 1. The container and lid assembly includes a walled storage vessel (42) within an airtight lid (38) with a connection means to an gas actuator on the lid. The preferred embodiment shall have a sealing valve similar to that of the injector sealing valve (22) which simultaneously opens and closes a lid injection tube (41) and lid exhaust tube (40) in a manner comparable to that of the opening and closure of bottle injector lead tube (20) and bottle injector exhaust tube (19) of FIG. 2, as described earlier. Similar to the arrangement shown in FIG. (2), the lid exhaust tube (40) has its lower aperture flush with the lid (38) of the container. The lid injection tube (41) is presized to extend nearly to the bottom of the container. The application of the actuator and the use of the lid sealing valve (39) is identical to the method described in FIGS. 2–3, with the comparable valve (22) on the bottle injection and sealing apparatus. The lid injection tube (41) is designed to fit snugly into the gas source component connector (16) of the actuator. The lid exhaust tube (40) is designed to fit snugly into the air exhaust component connector (17) of the actuator. The lid (48) is attached to the container (42) is an airtight manner in contact points (37) around the perimeter of the lid. The particle type of lid is well-known in the art including screw-on and snap-on lids. The height and shape of the wall (42) of the specialized container may vary. Both the lid (38) and the container walls (42) are typically made of a solid substance, such as plastic. The preferred design for such a container would place the gas injection tube as close to the wall (42) of the container as possible, so as to maximize storage capacity.

Figure 8:
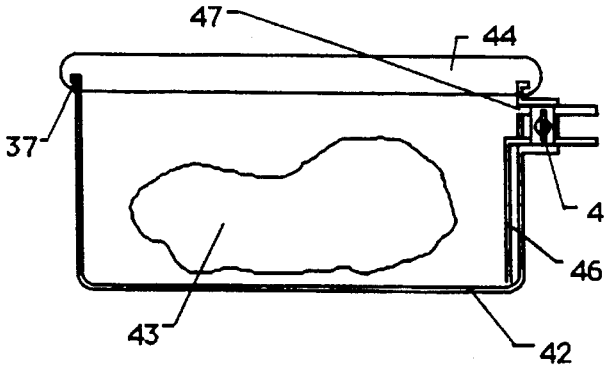
FIG. 8 is a side view of another container attached to a gas actuator assembly.

FIG. 8 illustrates a specialized container identical to that shown in FIG. 7 except that attachment for the gas actuator is on the container wall (42), instead of on the lid (44). The valved exhaust tube (47) is typically placed as high as possible on the side of the container, without interfering with the closure of the lid, for the same reasons as those given in the discussion of FIG. 2. The gas injection tube bends and follows the wall of the container (42) down to near the bottom to maximize capacity.

Figure 9:
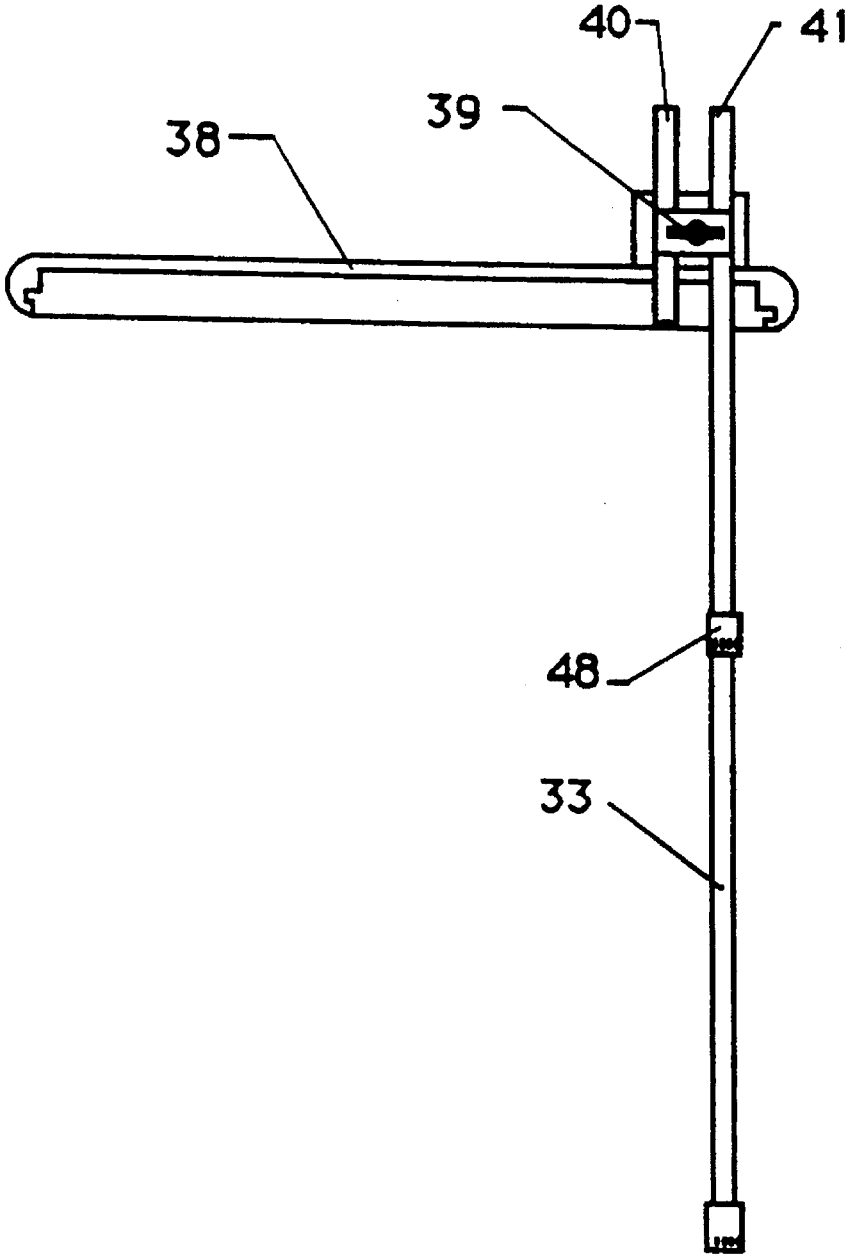
FIG. 9 is a side view of a lid of a food container attached to a gas actuator assembly.

FIG. 9 is an illustration of a multipurpose lid (38) which contains a means of connecting an actuator of the type shown in FIG. 1. The lid is intended to be placed onto original containers of food, thereby eliminating the need to decant the opened containers into specialized vessels, such as those of FIGS. 7 & 8. The lid is comparable to that shown in FIG. 7 with two principal differences: (a) it is intended to fit a variety of containers, rather than a single type of container and (b) the specialized lid gas injection tube (41) has a gas injector and connector tip (48) on it that is of the type shown in FIG. 2. This allows the extension tube (33) (shown in FIG. 3) to be attached in a manner similar to the embodiment of the invention shown in FIG. 5. Such attachment will allow sizing the injection tip to the container's height in a manner comparable to that described with respect to FIG. 3.

Several methods might be used to properly size such a lid so that it will fit onto an original container. For example, a multi-sized set of lids may be created to fit most major bottle and jar mouths. In addition, an elastic sidewall may be provided, allowing one lid to fit jar or bottle mouths of different sizes.

Figure 10:
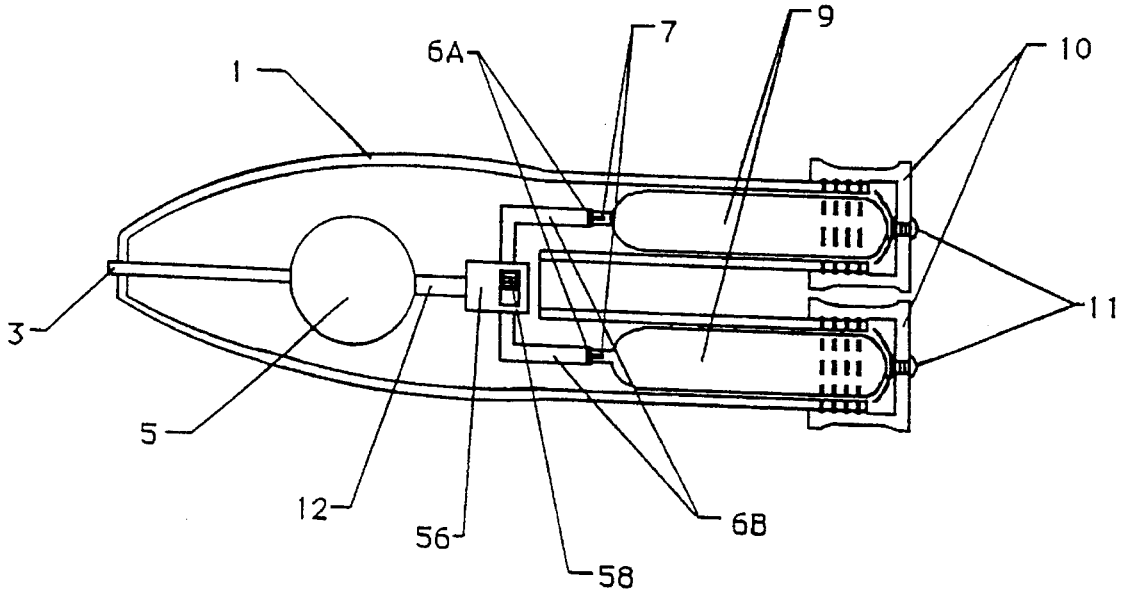
FIG. 10 is a top view of the gas actuator assembly shown in FIG. 1, modified for multiple gas sources.

FIG. 10 is an illustration of a gas source actuator assembly comparable to the type shown in FIG. 1, with a modification allowing the housing to hold simultaneously two gas cartridges (9) in a manner similar to that of the actuator assembly shown in FIG. 1. A gas source selecting switch (58) allows the operator to select one of the gas cartridges as the gas source for injection. This eliminates the need for removal of a gas cartridge in the event that the operator wishes to switch from use of one type of gas to use of another.

Figure 11:
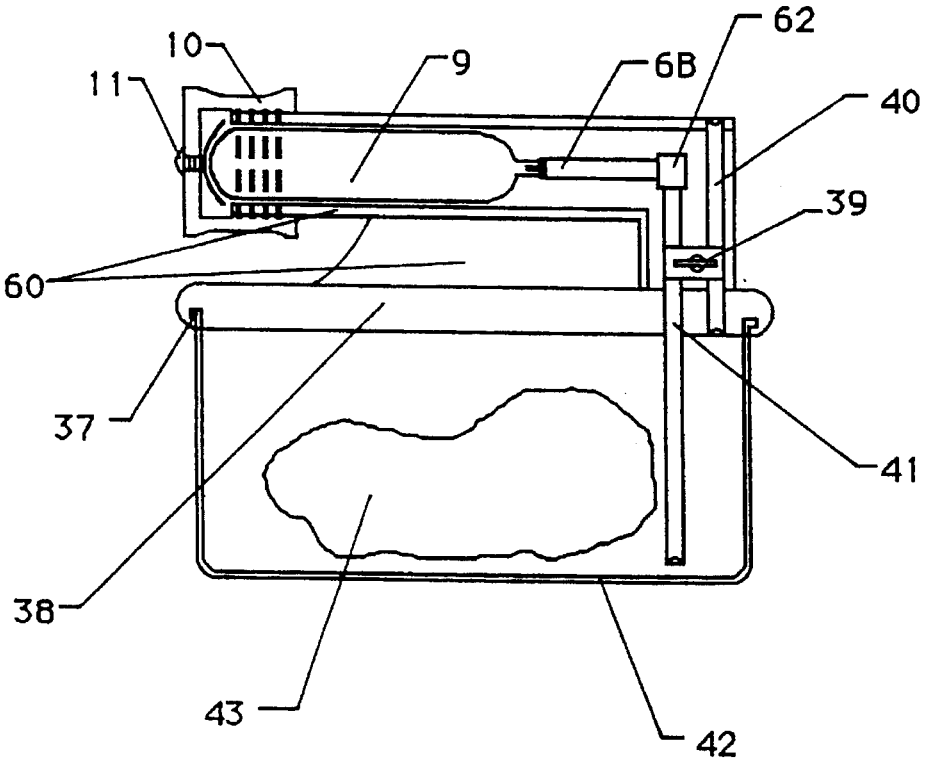
FIG. 11 is a side view of the container of FIG. 7, modified by a compressed gas source directly attached thereon.

FIG. 11 is an illustration of a specialized container identical to that shown in FIG. 7, except that an inert gas cartridge (9) is enclosed within a housing similar to that of the handgrip (8) shown in FIG. 1, which is operatively connected to the lid (38) of the container. The gas cartridge is operatively attached to the lid sealing valve (39), in a manner similar to that shown in FIG. 1. Activation of the sealing valve (39) will cause gas to flow from the cartridge (9), through the gas injection tube (41) and into the container, while the air within the container is simultaneously allowed to be expelled through the exhaust tube (40). Closing the valve (39) will stop the flow of gas from the cartridge. The use of one valve (39) eliminates the need for a pressure release valve of the type of valve (14), as the flow of gas to the container is unobstructed. Placement of the gas source directly on the container (as opposed to the embodiment illustrated in FIG. 1), reduces the number of steps that the operator need take to expel air from therein and makes the embodiment more compact.

Figure 12:
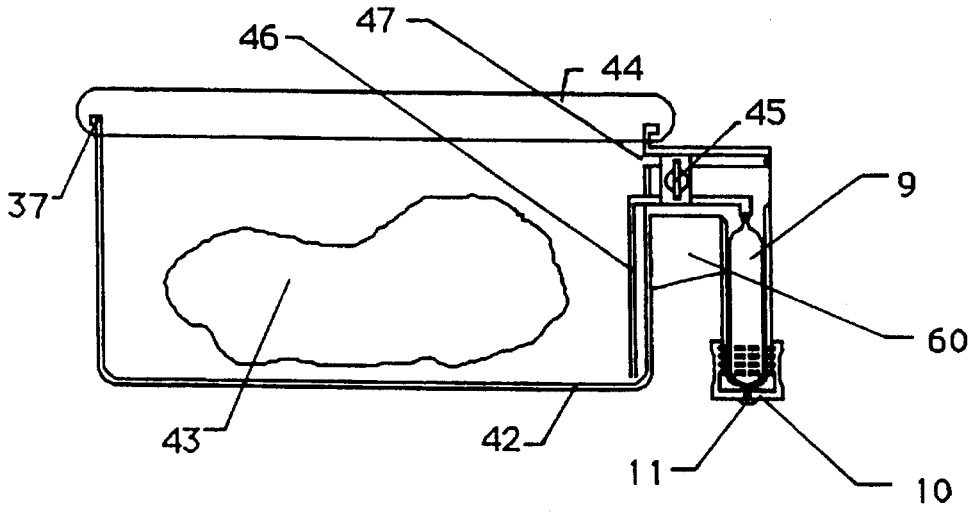
FIG. 12 is a side view of the container of FIG. 8, modified by a compressed gas source directly attached thereon.

FIG. 12 is an illustration of a specialized container identical to that shown in FIG. 8, except that an inert gas cartridge (9) is enclosed within a housing similar to that of the handgrip (8) shown in FIG. 1, which is operatively connected to the sidewall (42) of the container. The gas cartridge is operatively attached to the sidewall sealing valve (45), in a manner similar to that shown in FIG. 1. Activation of the sealing valve (45) will cause gas to flow from the cartridge (9), through the gas injection tube (46) and into the container, while the air within the container is simultaneously allowed to be expelled through the exhaust tube (47). Closing the valve (45) will stop the flow of gas from the cartridge. The use of one valve (45) eliminates the need for a pressure release valve of the type of valve (14), as the flow of gas to the container is unobstructed. Placement of the gas source directly on the container (as opposed to the embodiment illustrated in FIG. 1), reduces the number of steps that the operator need take to expel air from therein and makes the embodiment more compact.

Figure 13:
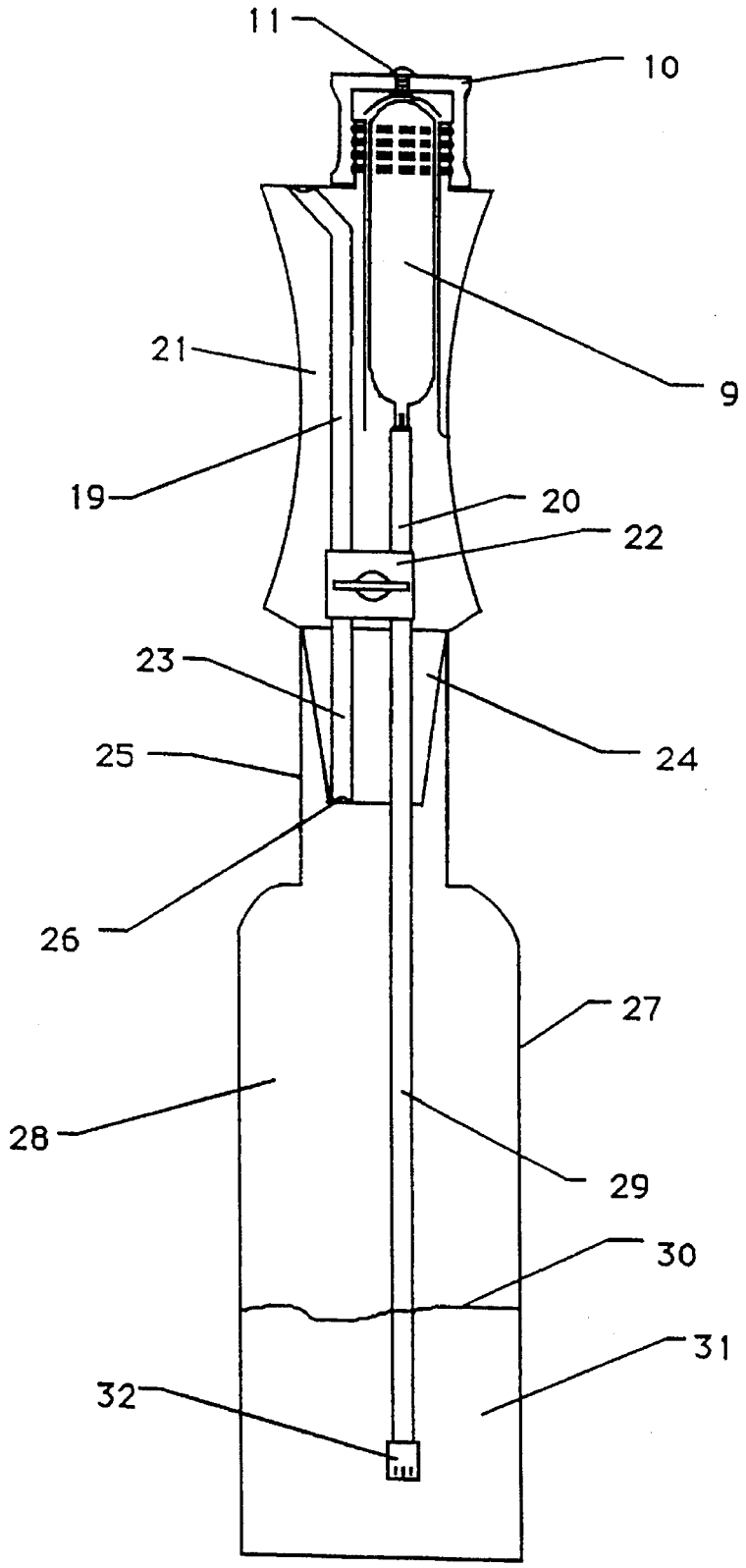
FIG. 13 is a side view of the bottle injection and sealing apparatus of FIG. 2, modified by a compressed gas source directly attached thereon.

FIG. 13 is an illustration of a bottle injector and sealing apparatus identical to that shown in FIG. 2, except that an inert gas cartridge (9) is enclosed within a housing similar to that of the handgrip (8) shown in FIG. 1, which is operatively connected within the handgrip (21). The gas cartridge is operatively attached to the injector sealing valve (22), in a manner similar to that shown in FIG. 1. Activation of the sealing valve (22) will cause gas to flow from the cartridge (9), through the gas injection tube (20) and into the bottle, while the air within the bottle is simultaneously allowed to be expelled through the exhaust tubes (23 & 19). Closing the valve (22) will stop the flow of gas from the cartridge. The us of one valve (22) eliminates the need for a pressure release valve of the type of valve (14), as the flow of gas to the bottle is unobstructed below the valve. Placement of the gas source directly within the bottle injector and sealing apparatus (as opposed to the embodiment illustrated in FIG. 1), reduces the number of steps that the operator need take to expel air from within the bottle and makes the embodiment more compact.

EXAMPLE 1

First, if one is not already installed, the user must install a cartridge of pressurized inert or unreactive gas into the gas actuator assembly described in FIG. 1. This is done by unscrewing the screwcap (10) on the handgrip (8) of the gas actuator assembly. Any empty cartridge (9) therein must be removed. Once the screwcap is removed, any cartridge within the handgrip (8) should be easily accessible and removable with one's finger. After removing the cartridge (9), if any, a new cartridge of inert or unreactive gas (9) is slid into the handgrip (8), making sure that the neck-end of the cartridge is inserted first. Resistance to further pushing will be felt as the cartridge's neck contacts the hollow connecting pin (7). The screwcap is then reinstalled and tightened. When the screwcap is fully tightened, the cartridge will have been pushed by the positioning guide (11) into the connecting pin (7), which will break the foil seal on the cartridge's neck allowing the pressurized gas to enter the gas transport tube (6B), thereby rendering the gas actuator ready for use.

A bottle injection and sealing apparatus of the type shown in FIG. 2 is installed into the bottle (27) with or without one or more extension tubes are needed. As a general rule, best results are obtained by having the user assure that the gas lead tube (29) is submerged so that the injector tip (32) is approximately 1–3 cm from the bottom of the bottle. Should this not be the case, one should attach an extension tube (52) of the type of FIG. 3 to the primary gas injection tip (32) so that the extension tube gas injector tip (34) is 1–3 from the bottom of the bottle. The device will still work even if the injection tube is further from the bottom of the bottle than the recommended distance. The distance is recommended to maximize displacement of any air that is dissolve in the wine or other liquid.

After the bottle injection and sealing apparatus has been properly sized, it should be inserted into the bottle (27). This is easily done by gripping the handgrip (21) and twisting the handgrip while pushing down. This will position and lower the tapered bottle corking interface (24) into the neck of the bottle. When substantial resistance to both downward and lateral motion is met, this will indicate that the tapered bottle corking interface (24) is securely fitted within the neck of the bottle. The injector sealing valve (22) is then opened and the bottle injection and sealing apparatus is ready for attachment to the gas actuator assembly.

The gas actuator assembly of FIG. 1 is attached to the bottle injection and sealing apparatus of FIG. 2, simultaneously aligning the actuator gas source component connector (16) above the bottle injector gas lead tube (20) and the actuator air exhaust component connector (17) above the bottle injector exhaust tube (19) and then by pushing down on the actuator assembly. The bottle injector exhaust tube (19) slides snugly inside the air exhaust component connector (17) and the bottle injector gas lead tube (20) slides snugly inside the gas source component connector (16). The actuator is now attached and the internal system completely sealed.

The button (5) on the gas actuator is actuated for 5–10 seconds for most applications, which will open the sealed system, allowing the compressed gas to enter the bottle and the displaced air within the bottle to exhaust. After the 5–10 second interval, the button (5) is released which reseals the newly-airfree system.

The next step is to close the valve (22) on the bottle injector apparatus. This seals the bottle system should one choose to remove the actuator. While the actuator is connected, the valves (12) and (13) serve to seal the system.

Once the valve (22) on the bottle injector is closed, it is safe to remove the gas actuator, by pulling upward on the actuator with one hand, while holding the gas injector steady at its handgrip (21) with the other hand. The gas injector will be left in the bottle, acting as a seal. To open a resealed bottle, the injector is pulled out of the bottle using the handgrip (21).

EXAMPLE 2

The procedure for the carbonation or recarbonation of a liquid in a bottle is essentially the same as that for the preservation of a bottle of wine or other perishable liquids described above in Example 1, with the sole exception that a cartridge (9) of compressed carbon-dioxide gas must be used instead of a cartridge (9) of inert or unreactive gas.

EXAMPLE 3

The procedure for carbonating an open container of a liquid requires that the actuator assembly contains a cartridge (9) of compressed carbon dioxide gas. An extension tube of the type shown in FIG. 3 is connected to the gas source component connector (16) of the actuator assembly of FIG. 1, in the method described earlier.

The extension tube gas injector tip (34) is inserted into the beverage or other liquid and the system thereby resembles that depicted in FIG. 6.

The actuator button (5) is depressed for 2–5 seconds for most applications, while stirring the beverage with the immersed extension tube. The carbon-dioxide gas vigorously bubbles out of the extension tube gas injector tip (34). After 2–5 seconds, the button (5) is released and the assembly removed from the liquid.

EXAMPLE 4

The preservation of food or other perishables in a container is conducted in the following manner. The food or other perishable items (43) are placed into the body of the container (42) and the lid attached thereto.

The actuator is provided with an inert or unreactive gas source cartridge (9), as described in Example 1. The actuator is attached to the exhaust and inlet tubes in the same manner as described in Example 1. As an example, for a container of the type shown in FIG. 7, where the valve assembly is on the lid (38), the actuator should be positioned over the valve assembly so that the gas source component connector (16) of the actuator is positioned over the specialized lid gas injection tube (41) and the air exhaust component connector (17) is positioned over the specialized lid exhaust tube (40). For a container of the type of FIG. 8, where the valve assembly is on the container (42), the actuator is aligned with the valve assembly so that the actuator's gas source component connector (16) is positioned adjacent to the valved container gas injection tube (46) and the air exhaust component connector (17) is positioned adjacent to the valved container air exhaust tube (47). By applying pressure on the actuator toward tubes (40&41) for a container of the type of FIG. 7 or toward tubes (46&47) for a container of the type of FIG. 8, the tubes on the container lid will snugly into the component connectors (16 & 17).

The next step is to open the specialized lid sealing valve (39) on a container of the type shown in FIG. 7 or the specialized container sealing valve (45) for a container of the type shown in FIG. 8.

The button (5) on the actuator is depressed for 5–10 seconds. This causes the air in the container to be replaced with inert or unreactive gas, similar to the process used in the preservation of wine. After 5–10 seconds, the button (5) is released to close the sealing valve (39 or 45) and remove the actuator. The container is now sealed and may be stored safely.

EXAMPLE 5

The preservation of food or other perishables in an original container using a specialized lid is conducted in the following manner. The lid (38) is fit onto the mouth of the original container. Once the lid is securely fastened onto the original container, the actuator, provided with an inert or unreactive source cartridge (9) in the manner described in Example 1, is attached to the specialized lid gas injection tube (41) and the specialized lid exhaust tube (40). Specifically, the actuator is positioned over the valve assembly so that the gas source component connector (16) is positioned over the specialized lid gas injection tube (41) and the air exhaust component connector (17) is positioned over the specialized lid exhaust tube (40). By applying pressure on the actuator toward tubes (40&41), the tubes on the container lid will snugly fit into the component connectors (16 & 17). The specialized lid sealing valve (39) is then opened.

The button (5) on the actuator is depressed for 5–10 seconds. This causes the air in the container to be replaced with inert or unreactive gas, similar to the process used in the preservation of wine. After 5–10 seconds, the button (5) is released to close the sealing valve (39) and remove the actuator. The container is now sealed and may be stored safely.

EXAMPLE 6

The preservation of food or other perishables in a container of the type illustrated in FIGS. 11 or 12 is conducted in the following manner. A cartridge (9) of unreactive or inert gas is installed into the housing (60) in a manner similar to that described in Example 1. The food or other perishable items (43) are placed into the body of the container (42) and the lid attached thereto. The sealing valve (39 or 45) is opened for 5–10 seconds. This permits the source gas to flood the interior of the container and the air to be expelled. After 5–10 seconds, the sealing valve (39 or 45) is closed and the container is now sealed and may be stored safely.

EXAMPLE 7

The preservation of wine or other perishable fluids in a bottle using a bottle injection apparatus of the type illustrated in FIG. 13 is conducted in the following manner. A cartridge (9) of unreactive or inert gas is installed into the housing (21) in a manner similar to that described with regard to the actuator in Example 1. The injector is then sized to the bottle height with extension tubes (52) and inserted into the bottle in the manner described in Example 1. The sealing valve (22) is opened for 5–10 seconds. This permits the source gas to flood the interior of the bottle and the air to be expelled. After 5–10 seconds, the sealing valve (22) is closed and the bottle is now sealed and may be stored safely.

The procedure for using a bottle injection apparatus of the type illustrated in FIG. 13 for carbonation or recarbonation of bottled liquids is identical except that cartridge (9) of unreactive or inert gas must be replaced with a cartridge (9) of carbon dioxide gas.

EXAMPLE 8

The procedure for using a gas actuator of the type illustrated in FIG. 10 is essentially the same as that described in Example 1. The two embodiments differ mainly in that the actuator of FIG. 10 allows two gas cartridges (9) to be housed simultaneously, whereas the actuator of FIG. 1 described in Example 1 allows one cartridge (9). A cartridge is installed into any one or both tubes of the handgrip, in the same manner as that described in Example 1. Prior to actuation of the button (5), the operator must switch the selection switch (58) thereby selecting the gas source that is to be used for the given application. All other steps in the use of the actuator of FIG. 10 are identical to that of the actuator of FIG. 1. The principal advantage of the dual cartridge configuration is that it does not require the operator to remove (and often waste) a cartridge in switching from an inert gas to carbon dioxide gas and vice-versa. It also provides for a doubling of the actuator's gas source capacity, should the operator use two cartridges of one type of gas.

The present invention provides a highly useful, inexpensive and portable means of resolving numerous problems encountered by today's consumers in the area of food and liquid preservation. Obvious modifications to the present invention would be apparent to those with ordinary skill in this art and are included with the spirit and the scope of the invention claimed.

For example, the actuator and its accessories may have a plurality of injection passages or exhaust passages. There may also be provided a plurality of valves used to open and close the passages. Similarly, the tubing need not be made of stainless steel or plastic, but may be made of other metals or organic materials.

The actuator may also hold several type of gas sources at once, thereby eliminating the need to remove cartridges when switching from an application that uses one type of gas to an application that uses another type of gas. FIG. 10 illustrates one preferred embodiment of this concept. The actuator may have a variety of shapes and the button (5) may be replaced by a twist valve. Similarly, the control valves (22, 39, 45) need not be twist activated, but may be activated by a button or similar mechanism. The connection tubes (15 & 18) may be flexible instead of rigid. Furthermore, the valves controlling the exhaust passages (13&22) may be replaced by one or more one-way valves, either is passage (19) or in passage (18) that release at pressures suitably above one atmosphere of pressure, allowing air to be exhausted only during injection. A similar substitution may be made for valve (39). Such valving may also replace the lock-type valving (22) controlling the injection tubes on the gas injector shown in FIG. 2, such that said valve only releases at pressures suitably above one atmosphere of pressure, allowing as to be injected only during deliberate injection.

It is not necessary that the bottle injector of food container require a separate gas actuator. A gas source (9), especially of the form of a cartridge, may easily be installed directly into the top of the injection valve of the bottle injector of FIG. 2, with attachment means similar to those found in the actuator, namely (6A, 6B, 7, 10, 11). Examples of this concept are shown in FIGS. 11, 12, and 13. This concept may be extended in a similar manner to other attachments.

Other attachments to the actuator include but are not limited to an attachment for the inflation of party balloons (should one use helium as the gas source), an attachment for the inflation of bicycle tires, a brush attachment allowing the forced gas to be used to dust camera lenses or eyeglasses, or an attachment for the whipping of cream. It is also possible for injection and exhaust means similar to those shown in FIGS. 7,8,9, to be included on original containers by the manufacturers of foods, cosmetics, or other perishables, with the intention that a consumer attach a gas actuator similar to that of FIG. 1 for air displacement, in order to extend products' shelf lives. Finally, the present device can be constructed as a tabletop model.

I claim:

1. A food storage container comprising:

a) a storage compartment;

b) a lid releasably sealed in an air-tight manner to the storage compartment; and c) a gas actuator assembly for supplying a gas to the storage compartment comprising:

i) a housing, ii) a pressurized gas source contained entirely within the housing, iii) first connector means for fluidically connecting the gas source to a compressed gas supply tube adapted to supply compressed gas to the interior of the storage compartment, iv) an evacuation tube adapted to evacuate air from the interior of the storage compartment, v) second connecting means for fluidically connecting the evacuation tube to an outlet formed in the housing for evacuating air contained within the storage compartment, and vi) actuation means fluidically connected to the first and second connector means for selectively enabling gas to travel from the gas source through the compressed gas supply tube into the storage compartment while substantially simultaneously enabling air to be evacuated from the storage compartment through the evacuation tube.

2. The food storage container of claim 1 wherein the pressurized gas source comprises a gas cartridge and the housing comprises means for exposing the cartridge to thereby enable replacement of the cartridge therein when the compressed gas within the cartridge has been exhausted.

3. The food storage container of claim 1 wherein the comprising a pressure release valve fluidically connected to the compressed gas supply tube.

4. The food storage container of claim 1 wherein the actuation means comprises a button positioned on the housing having a bottom contact surface for simultaneously activating valves disposed in the first and second connection means to release the compressed gas and evacuate the air from the storage compartment.

5. The food storage container of claim 1 wherein the compressed gas supply tube and the evacuation tube each have an end extending out of the housing, said ends respectively comprising connectors adapted to removably engage an extension device to thereby extend the length of the compressed gas supply tube and the evacuation tube.

6. The food storage container of claim 1 further comprising air-tight sealing means adapted for sealing the housing to the storage compartment.

7. The food storage container of claim 6 wherein the food storage compartment is a liquid containing vessel.

8. The food storage container of claim 7 wherein the compressed gas supply tube is adapted to extend into the liquid contained within the vessel.

9. The food storage container of claim 1 further comprising a sealing means adapted for engaging the food storage compartment in a sealing relationship, a first extension tube passing through the sealing device and fluidically connected to the compressed gas supply tube and a second extension tube passing through the sealing device and fluidically connected to the evacuation tube, said first extension tube being adapted to pass into the food storage compartment below a level of liquid contained therein and a sealing valve disposed within the sealing means adapted to simultaneously open the first and second extension tubes to permit gas to enter the food storage compartment and air to escape the food storage compartment.

10. The food storage container of claim 1 wherein the first extension tube comprises a plurality of apertures for emitting bubbles of gas to escape therefrom.

11. The food storage container of claim 11 further comprising an extension tube assembly comprising a first extension tube fluidically attached to the compressed gas supply tube, a second extension tube fluidically connected to the evacuation tube and a valve for opening and closing the first and second extension tubes, said extension tube assembly being fluidically connected to the food storage container.

12. The food storage container of claim 11 wherein the extension tube assembly is fluidically connected to the lid.

13. The food storage container of claim 11 wherein the extension tube assembly is fluidically connected to the food storage compartment.

14. The food storage container of claim 1 wherein the pressurized gas source comprises at least two cartridges containing compressed gas and the housing further comprises a switch valve allowing for selective passage of compressed gas from a single or said cartridge while inhibiting the passage of the compressed gas from the other of said cartridges.

* * * * *